US005565419A

United States Patent [19]

Thomas et al.

[11] Patent Number: 5,565,419

[45] Date of Patent: *Oct. 15, 1996

[54] OVEN CLEANING COMPOSITION

[75] Inventors: Barbara Thomas, Princeton, N.J.; Guy Broze, Grace-Hollogne, Belgium; Andrea Motyka, Doylestown, Pa.

[73] Assignee: Colgate Palmolive Company, Piscataway, N.J.

[ * ] Notice: The term of this patent shall not extend beyond the expiration date of Pat. No. 5,536,437.

[21] Appl. No.: 394,050

[22] Filed: Feb. 24, 1995

Related U.S. Application Data

[63] Continuation-in-part of Ser. No. 277,728, Jul. 21, 1994, abandoned, which is a continuation-in-part of Ser. No. 932,158, Aug. 19, 1992, abandoned.

[51] Int. Cl.[6] ..... C11D 3/08; C11D 1/83; C11D 3/28

[52] U.S. Cl. ..... 510/197; 510/218; 510/219

[58] Field of Search ..... 252/135, 174, 252/174.17, 542, DIG. 14

[56] References Cited

U.S. PATENT DOCUMENTS

| | | | |
|---|---|---|---|
| 5,393,455 | 2/1995 | Poethkow et al. | 252/174.25 |
| 5,423,997 | 6/1995 | Ahmed et al. | 252/99 |
| 5,427,707 | 6/1995 | Drapier et al. | 252/99 |

*Primary Examiner*—Paul Lieberman
*Assistant Examiner*—Michael P. Tierney
*Attorney, Agent, or Firm*—Richard E. Nanfeldt; James Serafino

[57] ABSTRACT

A shear thickening oven cleaning composition having a viscosity at room temperature at a shear rate of 2 radians/second for 30 seconds of about 1 to about 110 Pa.s and a viscosity at room temperature at a shear rate of 10 radians/second for 30 seconds of about 2 to about 190 Pa.s which comprises by weight percent of about 5 to about 50 of an alkali metal silicate; about 0.1 to about 25 of a cyclic nitrogen containing compound; about 0.01 to about 4.0 of an alkanolamine; about 0 to 15 of at least one surfactant and the balance being water.

7 Claims, No Drawings

OVEN CLEANING COMPOSITION

RELATED APPLICATION

This application is a continuation in part of U.S. application Ser. No. 8/277,728 filed Jul. 21, 1994 now abandoned which in turn is a continuation in part of U.S. application Ser. No. 7/932,158 filed Aug. 19, 1992 now abandoned.

FIELD OF THE INVENTION

This invention relates to shear thickening compositions in the form of liquids, sprays, gels and pastes, which remove dried-on and cooked-on food and other difficult-to-remove soils from kitchen utensils, flatware, dishes, glassware, cookware, bakeware, cooking surfaces, and surrounding areas in a convenient, easy, timely and mild manner.

Of the difficult-to-remove soils, the most severe is the baked and/or burned-on (especially when reheated and/or allowed to build up over time). Soil categories include grease, meat (including skin), dairy, fruit pie filling, carbohydrate and starch. Soiled substrate categories include aluminum, iron, stainless steel, enamel, Corningware, Pyrex and other glass cookware.

BACKGROUND OF THE INVENTION

Current light duty liquid detergents are dramatically deficient in these areas. The consumer has to soak soiled items for long periods of time in these solutions, and then use harsh cleaning methods (scouring with steel wool or scouring cleanser) to remove the remaining soil.

To speed up the process and increase efficacy of cleaning these soils, the consumer will resort to heat, scraping and harsh chemicals (e.g. caustic oven cleaners).

Deficiencies in these cleaning methods include time consumption for soaking and scouring, physical effort required for scouring and scraping, irritation to hands from harsh cleaning chemicals and methods, damage to objects from harsh chemicals and methods, unpleasant fumes and odors and danger from heated solutions. Though non-caustic cleaners are listed in the literature, none are directed to the cleaning compositions of the present invention.

U.S. Pat. No. 4,575,530 (Mar. 11, 1986) describes hydrocarbon solution additives which are polyampholytes which incorporates cationic and anionic moieties on the same polymeric backbone. These hydrocarbon solutions have shear thickening properties.

U.S. Pat. No. 4,536,539 (Aug. 20, 1985) claims include increasing the viscosity of water under increasing shear rates (22.0—approaching 100 $sec^{-1}$). This shear thickening behavior is primarily attributed to the increase in apparent molecular weight of the interpolymer complex through formation of intermolecular ionic linkages.

The instant patent teaches that these thickened silicates show shear thickening (dilatency), which is an increase in viscosity as shear rate is increased. Furthermore, the viscosity values at each shear rate are independent of the timescale of the experiment. Once the shear rate is applied, the viscosity reaches a steady value after a few seconds up to several minutes. Shear thickening occurs when the applied shear forces predominate the interparticle forces. The shear forces change the dispersion from a certain degree of order to clusters of particles. Shear thickening behavior is dependent on particle shape, size and size distribution; particle volume fraction; type and strength of inter-particle interaction; continuous phase viscosity and the experimental parameters characterizing the shear thickening. These parameters include the type, rate and duration of the applied shear deformation.

SUMMARY OF THE INVENTION

The shear thickening pre-spotting compositions of the present invention comprises a surfactant, water, an alkali metal silicate and imidazole. These shear thickening compositions may be formulated as clear, single-phase liquids, gels, or pastes and dispensed from bottles, squeeze bottles or paste dispensers. It has been found that applying the caustic-free compositions of the present invention to soiled surfaces removes the above mentioned soils at ambient temperature in a relatively short period of time (from 10 to 60 minutes) without need for heat, long soaking times, scouring or harsh chemicals.

All of the oven cleaning compositions disclosed in the prior art do not possess shear thickening properties. These compositions of the prior art are shear thinning as the rate of shear is increased. In other words, as the shear rate is increased as in the process of scrubbing, the viscosity of the composition will decrease. The compositions of the instant invention exhibit shear thickening properties at about 25° C. (room temperature) which means that as the shear rate is increased the compositions will shear thicken. The viscosity value at a given shear rate is independent of the time scale of the experiment. In a scrubbing process which causes an increase in the shear rate, the viscosity of the composition will increase and the composition will exhibit gel-like properties. This shear thickening property of the compositions of the instant invention make them especially useful on vertical surfaces because of their tendency not to run off of the vertical surface which is being cleaned as compared to the prior art compositions.

The viscosity measurements made on the instant composition are made on compositions that have not been subject to a prior stress as for example the viscosity measurements made in U.S. Pat. No. 4,871,467, wherein the composition is subjected to a stress which causes a decrease in viscosity and then the stress is removed from the composition and a recovery in viscosity occurs in that the viscosity increases to the original viscosity of the composition that it exhibited prior to the composition having been subjected to stress. The compositions of U.S. Pat. No. 4,871,467 are shear thinning and are not shear thickening. The viscosity of the compositions of U.S. Pat. No. 4,871,467 as shear is applied never increases above the initial viscosity of the composition at rest (no shear applied).

Accordingly, it is an object of the present invention to provide oven cleaning composition which is shear thickening at about 25° C. upon increasing shear rate.

The oven cleaning compositions according to the present invention comprise approximately by weight:

(a) from 5% to 50%, preferably 10% to 40%, of an alkali metal silicate;

(b) 0 to 5% of a surfactant selected from the group consisting of anionic surfactants and nonionic surfactants and mixtures thereof;

(c) 0 to 10% of a builder selected from the group consisting of alkali metal salts of polyphosphates, pyrophosphates, citrates and carbonates and mixtures thereof;

(d) 0.05% to 4% of an amine selected from the group consisting of monoethanolamine, diethanolamine and triethanolamine and mixtures thereof;

(e) 0.1% to 25% of a cyclic nitrogen containing compound such as an imidazole;

(f) 0 to 30%, preferably 0.1% to 15% of an organic compound having the formula $$C_nH_{2n+2-x}(OH)_x$$

wherein x is 1,2 or 3 and n is about 1 to about 20, more preferably about 1 to about 8;

and (g) the balance being water, wherein the composition does not contain any polymeric thickeners such as crosslinked polyacrylic acid polymers such as Carbopol 941 manufactured by B. F. Goodrich Co. and the composition does not contain any alkali metal hydroxide such as sodium hydroxide or potassium hydroxide, wherein the alkali metal silicate exists in the composition as a viscoelastic network structure of the alkali metal silicate.

Additionally, such formulations may include up to about 6% wt. of a foam booster, a foam stabilizer and a viscosity adjusting agent.

It has now been found that the problem of removing cooked-on and dried-on food residues from ovens can be resolved by applying at a temperature of about 25° C. (room temperature) to about 40° C. thereto for a relatively short time (10–30 minutes) the shear thickening pre-spotting composition of the present invention.

In accordance with the invention, the removal of cooked-on soils is thus effected by: contacting the soiled oven with an effective amount of the above-identified shear thickening pre-spotting compositions; allowing an effective amount of time (at least about 10 minutes) for the composition to soak through the soil; and then rinsing the affected soiled surfaces to remove the shear thickening pre-spotting composition and the loosened soil,

DETAILED DESCRIPTION OF THE INVENTION

The shear thickening pre-spotting compositions of this invention are comprised of the following components: an alkali metal silicate, optionally, at least one surfactant, optionally, an alkanolamine, imidazole, water, optionally, a water organic compound having the formula $C_nH_{2n+2-x}(OH)_x$ wherein x=1 to 3 and n=1 to 20, and optionally a builder. In addition to the above ingredients, the compositions of this invention may contain other substances generally present in detergent compositions. Foam stabilizing agents may be incorporated, and other ingredients which may normally be present include preservatives, humectants, foam boosters, anti-foaming agents, dispersants, pH modifiers, colorants and perfumes.

The surfactant, which is optionally present in the composition in the amount of about 0 to about 5 wt. %, more preferably 0.1 to 5 weight %, is selected from the group consisting of nonionic surfactants, anionic surfactants and their combinations. Preferably, the surfactant is present in the amount of about 1 to about 5 weight %.

The nonionic surfactant, preferably, is comprised of one or a mixture of primary alcohol ethoxylates or secondary alcohol ethoxylates or alkyl phenol ethoxylates. The primary alcohol ethoxylates are represented by the general formula:

$$R—O—(CH_2—CH_2—O)_n—H$$

wherein R is an alkyl radical having from 9 to 16 carbon atoms and the number of ethoxylate groups, n, is from 5 to 12. Commercially available nonionic surfactants of this type are sold by Shell Chemical Company under the tradename Neodol and by Union Carbide Corporation under the tradename Tergitol.

The secondary alcohol ethoxylates are represented by the general formula:

$$\begin{array}{l} CH_3—(CH_2)_x—CH—(CH_2)_y—CH_3 \\ \qquad\qquad\qquad\quad | \\ \qquad\qquad\qquad\quad O \\ \qquad\qquad\qquad\quad | \\ \qquad\qquad\qquad (CH_2—CH_2—O)_n—H \end{array}$$

Wherein x+y is from 6 to 15 and the number of ethoxylate groups, n, is from 5 to 12. Commercially available surfactants of this type are sold by Union Carbide Corporation under the tradename Tergitol S series surfactants, with Tergitol 15-S-9 (T 15-S-9) being preferred for use herein.

The alkyl phenol ethoxylates are represented by the general formula:

$$R\text{-(phenyl)-O-}(CH_2—CH_2—O)_n—H$$

where the number of ethoxylate groups, n, is from 8 to 15, and R is an alkyl radical having 8 or 9 carbon atoms. Commercially available nonionic surfactants of this type are sold by Rohm and Haas Company under the tradenames Triton N and Triton X series.

The anionic surfactant is preferably comprised of alkali metal salts of $C_{10}$–$C_{20}$ paraffin sulfonates, $C_{10}$–$C_{20}$ alkyl sulfates, $C_{10}$–$C_{20}$ ethoxylated alkyl ether sulfates, and $C_{10}$–$C_{20}$ alkyl benzene sulfonates, such as sodium linear tridecyl or dodecyl benzene sulfonate, sodium and/or ammonium alcohol 3-ethoxy sulfate (AEOS), sodium lauroyl, cocoyl or myristoyl sarcosinate or a combination thereof.

Alkylpolysaccharides surfactants which are also useful alone or in conjunction with the aforementioned surfactants and have a hydrophobic group containing from about 8 to about 20 carbon atoms, preferably from about 10 to about 16 carbon atoms, most preferably from 12 to 14 carbon atoms, and polysaccharide hydrophilic group containing from about 1.5 to about 10, preferably from 1.5 to 4, and most preferably from 1.6 to 2.7 saccharide units (e.g., galactoside, glucoside, fructoside, glucosyl, fructosyl, and/or galactosyl units). Mixtures of saccharide moieties may be used in the alkylpolysaccharide surfactants. The number x indicates the number of saccharide units in a particular alkylpolysaccharide surfactant. For a particular alkylpolysaccharide molecule x can only assume integral values. In any physical sample can be characterized by the average value of x and this average value can assume non-integral values. In this specification the values of x are to be understood to be average values. The hydrophobic group (R) can be attached at the 2-, 3-, or 4-positions rather than at the I-position, (thus giving e.g. a glucosyl or galactosyl as opposed to a glucoside or galactoside). However, attachment through the 1-position, i.e., glucosides, galactosides, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain, the preferred alkoxide moiety is ethoxide.

Typical hydrophobic groups include alkyl groups, either saturated or unsaturated, branched or unbranched containing from about 8 to about 20, preferably from about 10 to about 16 carbon atoms. Preferably, the alkyl group is a straight chain saturated alkyl group. The alkyl group can contain up to 3 hydroxy groups and/or the polyalkoxide chain can contain up to about 30, preferably less than 10, most preferably 0, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkylpolysaccharides. When used in admixture with alkylpolysaccharides, the alkylmonosaccharides are solubilized to some extent. The use of alkylmonosaccharides in admixture with alkylpolysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkylpolysaccharides are alkylpolyglucosides having the formula:

$$R_2O(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from 12 to 14 carbon atoms; n is 2 or 3 preferably 2, r is from 0 to about 10, preferable 0; and x is from 1.5 to about 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkylpolyglucosides can be prepared by a two step procedure in which a short chain alcohol ($R_1OH$) an be reacted with glucose, in the presence of an acid catalyst to form the desired glucoside. Alternatively the alkylpolyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R^2OH$) to displace the short chain alcohol and obtain the desired alkylpolyglucoside. If this two step procedure is used, the short chain alkylglucoside content of the final alkylpolyglucoside material should be less than 50%, preferably less than 10%, more preferably less than 5%, most preferably 0% of the alkylpolyglucoside.

The amount of unreacted alcohol (the free fatty alcohol content) in the desired alkylpolysaccharide surfactant is preferably less than about 2%, more preferably less than about 0.5% by weight of the total of the alkylpolysaccharide. For some uses it is desirable to have the alkylmonosaccharide content less than about 10%.

The used herein, "alkylpolysaccharide surfactant" is intended to represent both the preferred glucose and galactose derived surfactants and the less preferred alkylpolysaccharide surfactants. Throughout this specification, "alkylpolyglucoside" is used to include alkyl- polyglycosides because the stereo chemistry of the saccharide moiety is changed during the preparation reaction.

An especially preferred APG glycoside surfactant is APG 625 glycoside manufactured by the Henkel Corporation of Ambler, Pa. APG 25 is a nonionic alkylpolyglycoside characterized by the formula:

$$C_nH_{2n+1}O(C_6H_{10}O_5)_x^H$$

wherein n=10(2%); n=12(65%); n=14(21-28%); n=16(4–8%) and n=18 x(degree of polymerization)=1.6. APG 625 has: a pH of 6–8(10% of APG 625 in distilled water); a specific gravity at 25° C. of 1.1 grams/ml; a density at 25° C. of 9.1 kgs/gallons; a calculated HLB of about 12.1 and a Brookfield viscosity at 35° C., 21 spindle, 5–10 RPM of about 3,000 to about 7,000 cps. Mixtures of two or more of the liquid nonionic surfactants can be used and in some cases advantages can be obtained by the use of such mixtures.

The composition also contains about 0 to about 10 weight % of a builder salt or electrolyte, which is comprised of phosphates, such as tetrapotassium pyrophosphate, sodium tripolyphosphate; carbonates, such as sodium carbonate, sodium sesquicarbonate and sodium bicarbonate sodium gluconate, citrates, such as sodium citrate; and sodium ethylene diamine tetraacetate. The preferred amount of the builder in the composition is about 0.5 to about 5 weight %.

The composition contains about 0.1 to about 25 weight %, more preferably about 0.1 to about 10 wt. % of a cyclic nitrogen containing compound such as pyrrolidine, pyridine, 2 pyrrolidine, N-methyl, 2- pyrrolidine, imidazole, morpholine, and diethylenetriamine, wherein the preferred cyclic nitrogen containing compounds are imidazole and 4-methylimidazole. Imidazole is especially preferred. Triethylenediamine or 1,4-diaza bicylco [2,2,2] octane also works in place of the aforementioned cyclic nitrogen containing compounds in the instant composition.

Also present in the composition is 0 to about 4 weight % of an alkanolamine selected from the group consisting of monoethanolamine, diethanolamine and triethanolamine and mixtures thereof. About 0.1 to about 1.0 weight % of the alkanolamine in the composition is preferred.

The shear thickening characteristics of the instant composition are directly attributable to the alkali metal silicate present in the composition. The alkali metal silicate interacts with both the alkanolamine and the imidazole in the composition thereby imparting shear thickening properties to the composition. The instant compositions do not contain any polymeric thickener such as crosslinked acrylic acid polymers of copolymers.

The mechanism of thickening is such that electrolyte hydroxy containing organic compound, imidazole and/or alkanolamine condenses the alkali metal silicate by binding the water to the hydroxy containing organic compound, the electrolyte, imidazole or alkanolamine thereby promoting the aggregation of the alkali metal silicate into a viscoelastic network structure of the alkali metal silicate.

The alkali metal silicate is present in the composition at a concentration of about 5 to about 50 weight %, more preferably about 10 to about 45 weight % and most preferably about 15 to about 40 weight %. The alkali metal silicates are selected from the group consisting of lithium silicate, sodium silicate and potassium silicates and mixtures thereof. The potassium silicate is characterized by the formula $(K_2O)_xSiO_2$ wherein x>2.10 and the potassium silicate has a water content of less than 66 weight %. The sodium silicate is characterized by the formula $(Na_2O)_ySiO_2$ wherein y>2.88 and the sodium silicate has a water content of less than 61 weight %. The lithium silicate is characterized by formula $(Li_2O)zSiO_2$ wherein z>2.1 and the lithium silicate has a water content of less than 65 weight %. The alkali metal silicates used in the process of making the instant composition are in an aqueous solution comprising about 30 wt. % to about 60 wt. % of the alkali metal silicate and the balance being water. For example, a 39 wt. % aqueous solution of $(K_2O)2.1\ SiO_2$ was used in Example 1. This means that 87.1 grams of the 39% aqueous solution the potassium silicate in Example I-A was used to provide 34 wt. % of the potassium silicate. The water from the aqueous solution of the potassium silicate is reflected as part of water as shown in Examples 1A–1D on the line indicating the wt. % of water.

Water completes the balance of the composition and the pH of the composition is about 10 to about 13, preferably about 12 to about 13.

The compositions of this invention are prepared by adding with stirring in a suitable mixer and homogenizer at a temperature of about 15° C. to about 30° C. an aqueous solution of imidazole and/or alkanolamine to an aqueous solution of the alkali metal silicate selected from the group consisting of lithium silicate, sodium silicate and potassium silicate, wherein the alkali metal silicate is in an aqueous solution at a concentration of about 30 wt. % to about 60 wt. %. The resultant composition of the alkali metal silicate, water, cyclic nitrogen containing compound such as imidazole and the alkanolamine exhibits dilatant characteristics. The viscosity of the resultant compositions for a shear rate of 2 radians/second at about room temperature (25° C.) as applied for 30 seconds is about 1.0 to about 110 Pa.s and at a shear rate of 10 radians/second at about room temperature (25° C.) as applied for 30 seconds of about 2 to about 190 Pa.s., wherein the viscosity of the composition at a shear rate of 10 radians/second is always greater than the viscosity of the same composition at a shear rate of 2.0 radians/second for the same composition. When the viscosity is plotted against the shear rate for the compositions of the instant invention a positive slope is obtained thereby indicating that the instant compositions are shear thickening. Upon the application of increasing shear rate to an aqueous solution of the composition the aqueous solution will shear thicken and an increase in viscosity will occur. The increase is independent of the time scale of the experiment. The compositions of the prior art exhibit a negative slope thereby showing these compositions are non shear thinning—decrease in viscosity. To the shear thickening solution of the alkali metal silicate, water, imidazole and alkanolamine can be added various ingredients in any order, wherein the order of addition is not critical and the addition of these ingredients does not destroy the shear thickening property of the composition. The various ingredients are added at a temperature of about 15° C. to about 30° C., with a moderate shear rate of mixing of about 300 to about 800 rpms. The various ingredients that can be added are the non-soap anionic surfactants, the nonionic surfactant and optionally, a builder. The addition of these ingredients to the composition of the alkali metal silicate, water, imidazole and alkanolamine will not destroy the shear thickening characteristics and the final composition will exhibit a viscosity at 25° C. of about 1 to about 110 Pa.s at a shear rate of 2 radian/second at room temperature as applied for 30 seconds and about 2 to about 190 Pa.s at a shear rate of 10 radians/seconds as applied for thirty seconds at room temperature.

The instant compositions do not contain metal hydroxides; however, the instant compositions may optionally contain alkali metal halides such as lithium chloride, sodium chloride and potassium chloride in an amount of about 0.1 to about 15 weight %, wherein the alkali metal halide will aid as a structuring agent as does the cyclic amine for the alkali metal silicate. An organic compound having at least one hydroxyl group such as propylene glycol or 1,6-hexanediol can be used as a structuring agent for the alkali metal silicate. The organic compound having at least one hydroxyl group has the formula:

$$C_nH_{2n+2-x}(OH)_x$$

wherein n is about 1 to about 20, more preferably about 1 to about 10 and x=1,2 or 3 and the concentration of the organic compound is about 0 to about 30 wt. %, more preferably about 0.1 to about 15.0 wt. %. Also suitable as structuring agents are nonionic surfactants containing a hydroxyl group.

The following examples will serve to illustrate the present invention without being deemed limitative thereof. Parts and percents are by weight unless otherwise indicated.

EXAMPLE 1

Formulation of the following ingredients are prepared:

TABLE I

| | A | B | C | D |
|---|---|---|---|---|
| $K_2O(2.1)ISiO_2$[1] | 34 | 33 | 30 | 32 |
| Water | 59 | 60 | 62.4 | 60 |
| Imidazole | 5 | 5 | 5 | 5 |
| Triethanolamine | 1 | 1 | 1 | 1 |
| APG 625[2] | 1 | 1 | 1 | 1 |
| LiCl | — | — | 0.6 | — |
| Propylene Glycol | — | — | — | 2 |
| Appearance | very thick clear | thick clear | thick clear | thick clear |
| Viscosity Pa.s, RT, shear rate 2 radians/second | 116 | 2 | 8.4 | 1 |
| Viscosity Pa.s, RT, shear rate 10 radians/second | 184 | 2.5 | 25 | 1.3 |

1. This was used as 39 wt. % aqueous solution of $K_2O(2.1)\ SiO_2$. Therefore for example in Example 1A 87.1 grams of the aqueous solution was used which yield 34 grams of the $K_2O(2.1\ )\ SiO_2$. This means that of the 59 grams of water in 1A that 53.1 grams came from the aqueous solution of the $K_2O(2.1)\ SiO_2$.

2. APG 625 is manufactured by Henkel and is an alkypolyglycoside with D.P=1.6 and a hydrophobe chain length of $C_{12}$.

A 39% solution of the potassium silicate and water was prepared. (39 wt. % of potassium silicate) with stirring at room temperature for 5 minutes. To the (39%) solution of the potassium silicate and water is added with stirring at room temperature for 5 minutes an aqueous solution of the imidazole triethanolamine and surfactant.

These formulations were tested on Crisco shortening baked at 350° F. for 10 hours on a 2 inch pyrex petri dishes and macaroni cheese for one hour at 350° F. Approximately 4 g of each formula was used and the soil was soaked at room temperature for 1 hour. The formulations were then rinsed off with tap water and light rubbing to remove loosened soil. Percent soil removal was determined gravimetrically. Three replicates were run for each formula. The results are presented in Table 2.

TABLE 2

| | % Soil Removal | |
|---|---|---|
| Formula | Crisco Shortening | Macaroni & Cheese |
| A | 37 | 91 |
| B | 33 | 88 |
| C | 38 | 98 |
| D | 32 | 98 |
| Formula 409 Commercial product | 2 | 79 |

The silicate thickened formulas show superior efficacy on the Crisco shortening soil to formula 409 a commercial multi-surface spray cleaner. The results for macaroni & cheese are also better than the previous prototype and equal to slightly better than formula 409. These formulas do not cause damage to aluminum even though the pH is 12.5; however, formula 409, pH 12.5 does damage aluminum.

Since these formulas are thickened they will cling to vertical surfaces better. These formulas (0.5 g) were applied in a 3 inch line to Aluminum sheets and the time for the formula to travel 6 inches after the sheet was tilted vertically was measured. The results are shown in Table 3.

TABLE 3

| | Vertical Hang Measurements |
|---|---|
| Formula # | Time for 6 in (sec) |
| A | 1 inch in 14 minutes |
| B | 2 inches in 15 minutes |
| Formula 409 Commercial product | <1 |

The silicate thickened formulas have significantly longer vertical hang times than formula 409 and comparable in or longer than a previous prototype which was thickened with a polyacrylate. These formulas should be easier to use and less messy when vertical surfaces need to be cleaned.

What is claimed is:

1. A shear thickening composition which consisting essentially of:

(a) 5% to 50% of an alkali metal silicate selected from the group consisting of $Li_2O(zSiO_2)$, wherein $z>2.1$, $Na_2O(xSiO_2)$, wherein $x>2.88$ and $K_2O(ySiO_2)$ wherein $y>2.1$;

(b) 0.1 to 15% of an organic compound having the formula $$C_nH_{2n+2-x}(OH)_x$$

wherein x equals 1, 2 or 3 and n is about 1 to about 20;

(c) about 0.1–5% of at least one surfactant compound selected from the group consisting of an ethoxylated nonionic surfactant and an anionic surfactant;

(d) about 0.1 to 1.0% of an alkanolamine;

(e) 0.1 to 10% of a cyclic nitrogen containing compound selected from the group consisting of imidazole, 4-methylimidazole, pyridine, pyrrolidine, N-methyl-2pyrrolidine, and morpholine; and (f) the balance being water, said composition has a viscosity at 25° C. at a shear rate of 2 radians per second applied for 30 seconds of about 1 to about 110 Pascal seconds and a viscosity at 25° C. of about 2 to 180 $P_{ao}$·s at a shear rate of 10 radians/seconds applied for 30 seconds, the viscosity of said composition at 25° C. increases as the shear rate on said composition increases, wherein the viscosity at 25° C. for said composition at a shear rate of 10 radians/second as applied for 30 seconds is greater than the viscosity at 25° C. for the same said composition at a shear rate of 2.0 radians/second as applied for 30 seconds for said composition, wherein the alkali metal silicate exist in the composition as a viscoelastic network structure of the alkali metal silicate, wherein said composition does not contain any polyacrylic acid polymer and wherein the pH of the composition ranges from about 12 to about 13.

2. The composition of claim 1 further including 0.1 to 15 wt. % of an alkali metal halide.

3. The composition of claim 1 wherein said alkanolamine is selected from the group consisting of monoethanolamine, diethanolamine and triethanolamine and mixtures thereof.

4. The composition of claim 1 further including a foam depressant selected from the group consisting of silicones and alkyl or ethoxylated alkyl phosphate esters.

5. The composition of claim 1 which does not contain alkali metal hydroxides.

6. The composition of claim 1 wherein said cyclic nitrogen containing compound is imidazole or 4-methylintidazole.

7. A composition according to claim 1 further including 0 to 10% of an alkali metal builder salt selected from the group consisting of sodium citrate, potassium citrate, sodium carbonate, potassium carbonate, sodium polyphosphate, potassium polyphosphate and potassium pyrophosphate and mixtures thereof.

* * * * *